US005443140A

United States Patent [19]

Nagel et al.

[11] Patent Number: 5,443,140

[45] Date of Patent: Aug. 22, 1995

[54] METHOD AND APPARATUS FOR REDUCING THE POWER REQUIRED BY AN HYDRAULIC ELEVATOR DRIVE

[75] Inventors: Heinz-Dieter Nagel; Jörg Christians; Gerald Lechler, all of Berlin, Germany

[73] Assignee: Inventio AG, Hergiswil, Switzerland

[21] Appl. No.: 16,006

[22] Filed: Feb. 10, 1993

[30] Foreign Application Priority Data

Feb. 10, 1992 [CH] Switzerland ..... 00390/92

[51] Int. Cl.[6] ..... B66B 11/04

[52] U.S. Cl. ..... 187/253

[58] Field of Search ..... 157/20, 26, 94, 111, 157/110, 17, 29.2; 60/461, 475; 91/436, 440, 474, 475, 476

[56] References Cited

U.S. PATENT DOCUMENTS

| | | | |
|---|---|---|---|
| 10,017 | 1/1882 | Baldwin | 187/94 |
| 482,247 | 9/1892 | Hale | 187/94 |
| 551,765 | 12/1895 | Heermans | 187/26 |
| 3,916,768 | 11/1975 | Martin | 91/436 |
| 3,977,497 | 8/1976 | McMurray | 187/111 |
| 4,977,980 | 12/1990 | Hifumi | 187/20 |
| 5,014,823 | 5/1991 | Pelto-Huikko | 187/17 |
| 5,048,644 | 9/1991 | Pelto-Huikko | 187/17 |

FOREIGN PATENT DOCUMENTS

| | | | |
|---|---|---|---|
| 2735310 | 2/1979 | Germany . | |
| 3002577 | 7/1981 | Germany . | |
| 3629032 | 4/1988 | Germany . | |
| 3873 | 1/1991 | Japan | 187/111 |

*Primary Examiner*—Kenneth W. Noland
*Attorney, Agent, or Firm*—Howard & Howard

[57] ABSTRACT

An apparatus for reducing the driving power required for an hydraulic elevator in which the elevator car is suspended in the shaft by a cable connected with a piston rod of an hydraulic piston-cylinder drive providing two units of distance of car travel for each unit of distance of piston movement. A counterweight is connected to the head end of the piston rod for travel equal in distance and opposite in direction to the car travel. The counterweight is selected to balance the weight of the car and the most frequently occurring car load. A pump supplies pressured fluid to the cylinder of the drive and, during upward travel of the elevator car, a control system provides a differential circulation of the fluid whereby a smaller fluid volume can be used for the dimensioning of the pump.

10 Claims, 4 Drawing Sheets

METHOD AND APPARATUS FOR REDUCING THE POWER REQUIRED BY AN HYDRAULIC ELEVATOR DRIVE

BACKGROUND OF THE INVENTION

The present invention relates generally to an apparatus for driving an elevator and, in particular, to an apparatus for reducing the power required to drive an hydraulic elevator.

An hydraulic elevator, in which an hydraulic drive of the piston-cylinder type is positioned beside the elevator car in the elevator shaft, is shown in the German patent document DE GM 69 26 58. The drive cylinder is mounted on a bracket in the shaft pit and a cable guide roller is mounted below the bracket. Two additional cable guide rollers are attached at the upper end of the piston rod of the drive. One end of a hoist cable is fixed at the shaft wall in the region of the bracket and the other end is fixed in the upper region of the elevator shaft. The hoist cable extends from the lower fixed point upwardly and over one of guide rollers at the upper end of the piston rod, downwardly and about the guide roller at the bracket, upwardly and about the other guide roller at the upper end of the piston rod, downwardly and about two guide rollers attached to the base of the elevator car, and upwardly to the upper fixed point in the shaft. Thus, the elevator car is suspended in a downwardly directed loop of the hoist cable. Due to the looping of the hoist cable, the elevator car moves at twice the piston speed and twice the vertical travel of the piston rod. Without considering the friction losses, the force required to be generated at the piston rod corresponds to twice the value of the weight of the elevator car and the conveyed load.

A method and apparatus for improving the performance of a motor-driven hydraulic elevator, in which the speed of travel of the elevator car is controlled through change in the rotational speed of an electrical motor driving an hydraulic pump, is shown in the German patent document DE-OS 38 36 212 (see U.S. Pat. Nos. 5,014,823 and U.S. Pat. No. 5,048,644). An improvement in the performance and a reduction in the thermal loading of the electrical motor is achieved by reducing the oil pressure in the main hydraulic line to a predetermined constant level with the aid of a reducing valve during the drive of the elevator in the downward direction. The reducing valve is provided with a return path in which a pressure-equalizing valve controls the flow volume through the reducing valve to the main line. Thus, a smaller quantity of electrical energy is needed during the downward travel, whereby the thermal loading of the electrical motor is also reduced.

SUMMARY OF THE INVENTION

The present invention concerns an apparatus for operating an hydraulic elevator. The elevator includes an elevator car positioned for vertical movement in an elevator shaft, an hydraulic piston-cylinder type drive positioned laterally beside the elevator car in the shaft, the drive having a cylinder with one end attached a bottom portion of the shaft, a piston movable in the cylinder, and a piston rod extending upwardly through an opposite end of the cylinder, a hoist cable having one end fixed to an upper point in an upper portion of the shaft and an opposite end fixed to a lower point in a lower portion of the shaft, the hoist cable supporting the elevator car in the shaft and being coupled to the piston rod for moving the elevator car two units of distance for each unit of distance moved by the piston rod. A control system for the drive includes an hydraulic pump having a pressured fluid outlet and a fluid inlet connected to a reservoir of fluid, a throughflow check valve having first and second ports, a first line connected from an upper opening in the cylinder above the piston to the first port of the throughflow check valve, a proportional multi-way valve having first, second, third and fourth ports, a second line connected from the first port of the proportional multi-way valve to a lower opening in the cylinder below the piston, a third line connected from the second port of the proportional multi-way valve through a first non-return valve for fluid flow to the third port of the throughflow check valve, the second port of the throughflow check valve being connected to the second port of the proportional multi-way valve, a fourth line connected from the fourth port of the proportional multi-way valve through a second non-return valve for fluid flow to the reservoir, and a main line connected from the outlet of the pump through a third non-return valve for fluid flow to the third port of the proportional multi-way valve. The proportional multi-way valve is selectively actuatable to a first mode for fluid flow from the pump to the upper opening in the cylinder through the third port and the second port and fluid flow from the lower opening in the cylinder to the reservoir through the first port and the fourth port for downward travel of the elevator car. This multi-way valve also is selectively actuatable to a second mode for fluid flow from the pump to the lower opening in the cylinder through the third port and the first port and fluid flow from the upper opening in the cylinder to the third port for upward travel of the elevator car.

The advantages achieved by the present invention are that a load equalization, whereby a saving in energy consumption results, arises in the most frequently occurring loads through a counterweight system attached at the head end of the piston rod. The counterweight moves in a direction opposite to but the same distance as the elevator car. The counterweight corresponds to the weight of the elevator car plus the most frequently occurring car load weight. A further advantage of the invention is that the size of the pump can be adapted for a smaller fluid volume due to the differential circulation of the fluid flows which takes place during the upward travel, whereby equipment costs are less and there is a savings in energy consumption.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
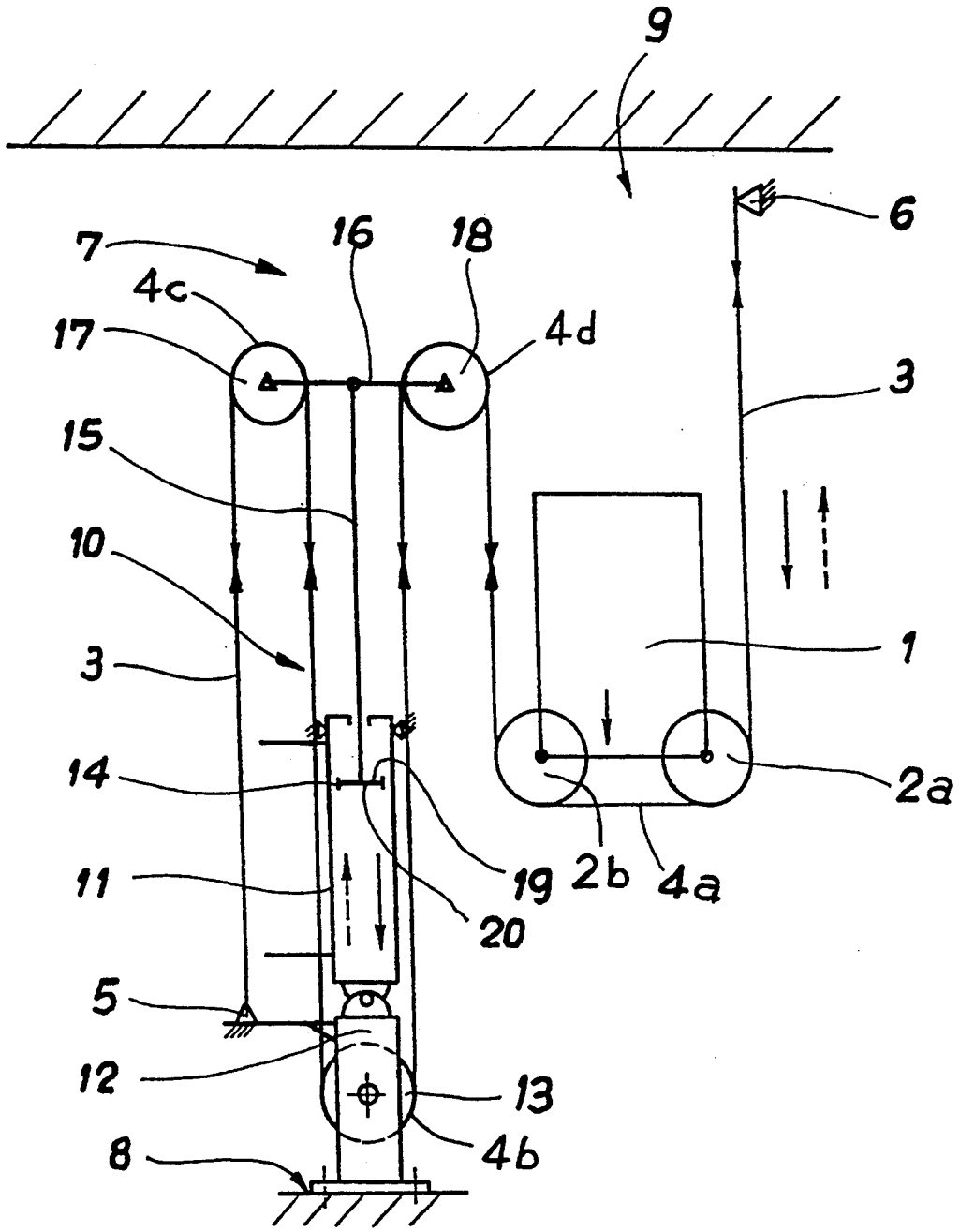
FIG. 1 is a schematic view of an elevator system having an elevator car connected by a cable to an hydraulic drive.
Figure 2:
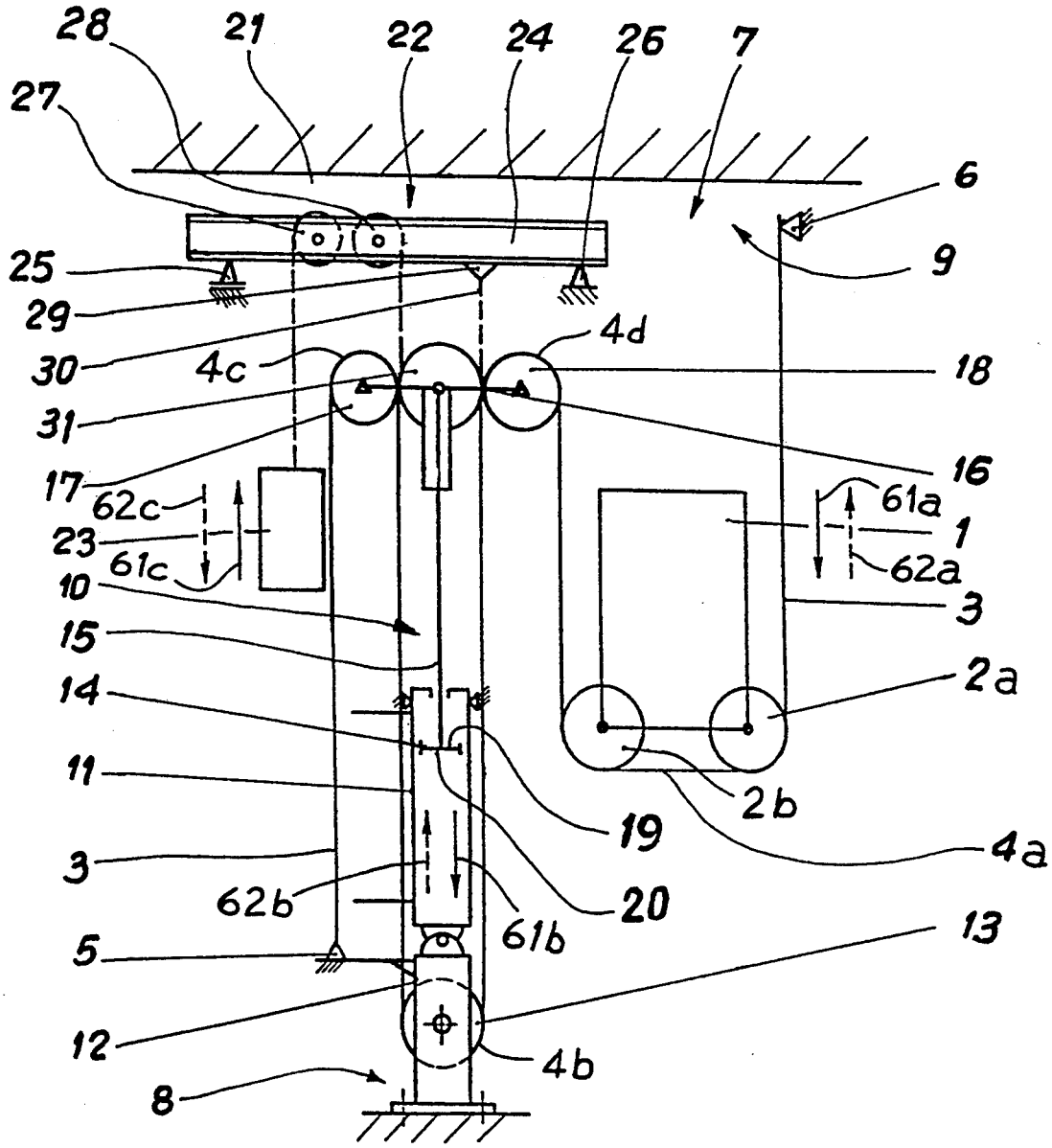
FIG. 2 is a schematic view of an elevator system similar to the system shown in the FIG. 1 including a counterweight.

In the FIGS. 1 and 2, there are shown schematically elevator systems without and with a counterweight respectively. Each of the elevator systems includes an elevator car 1 having a pair of cable guide rollers, a first roller 2*a* and a second roller 2*b*, rotatably attached to opposite sides of a lower end thereof. A hoist cable 3 has a section which extends about a portion of the circumference of each of the rollers 2*a* and 2*b* in a first lower loop 4*a* to support the car 1 in an elevator shaft 7. A first end 5 of the hoist cable 3 is fixed in a lower region 8 of the elevator shaft 7 and a second opposite end 6 of the hoist cable 3 is fastened in an upper region 9 of the shaft 7.

Each of the elevator systems shown in the FIGS. 1 and 2 also includes an hydraulic drive 10 includes a generally vertically extending cylinder 11 having a lower end pivotally attached to a bracket 12 mounted in the lower region 8 of the shaft 7. A third cable guide roller 13 is rotatably attached to the bracket 12 and a second lower loop 4*b*, a section between the first lower loop 4*a* and the first end 5 of the cable 3, extends about a portion of the circumference of the roller 13. The hydraulic drive 10 includes a piston 14 which is movable along a vertical axis of the cylinder 11. The piston 14 is attached to a piston rod 15 which extends outwardly from an upper end of the cylinder 11. An upper or head end 16 of the piston rod 15 has a pair of horizontally spaced apart cable guide rollers rotatably attached thereto, a fourth roller 17 and a fifth roller 18. A section of the cable 3 between the first end 5 and the second lower loop 4*b* extends about a portion of the circumference of the roller 17 in a first upper loop 4*c* and another section of the cable 3 between the first lower loop a and the second lower loop 4*b* extends about a portion of the circumference of the roller 18 in a second upper loop 4*d*. The piston 14 has a generally circular upper pressure surface 19 to which the piston rod 15 is attached and a generally circular lower pressure surface 20 on the opposite side thereof. The area of the lower pressure surface 20 is typically twice as large as the area of the upper pressure surface 19. The hoist cable 3 extends upwardly from the first fixed end 5 in the lower region 8 of the shaft 7 around the fourth guide roller 17 at the head end 16 of the piston rod 15, downwardly and around the third guide roller 13 at the bracket 12, upwardly and around the fifth guide roller 18 at the head end 16 of the piston rod 15, downwardly and around the second guide roller 2*b* and the first guide roller 2*a* attached to the elevator car 1, and upwardly to the second end 6 in the upper region 9 of the shaft 7.

In the FIG. 2, there is shown an addition to the elevator system described above in the form of an apparatus 22 for mounting a counterweight 23 at an upper end 21 of the shaft 7. The apparatus 22 includes a generally horizontally extending carrier beam 24 supported at opposite ends on a pair of spaced apart bearing points 25 and 26. A pair of horizontally spaced apart guide rollers, a sixth roller 27 and a seventh roller 28, are rotatably attached to the beam 24 and a fixed point 29 is provided on the beam between the bearing point 26 and the roller 28 for the fastening of one end of a counterweight cable 30. An eighth cable guide roller 31 is rotatably attached to the head end 16 of the piston rod 15 between the guide rollers 17 and 18. The counterweight cable 30 is shown as a dashed line to avoid confusion with the hoist cable 3. The cable 30 extends from the fixed point 29 downwardly and around a portion of the circumference of the roller 31, upwardly and around a portion of the circumference of each of the rollers 28 and 27, and downwardly to an opposite end attached to the counterweight 23.

Figure 3:
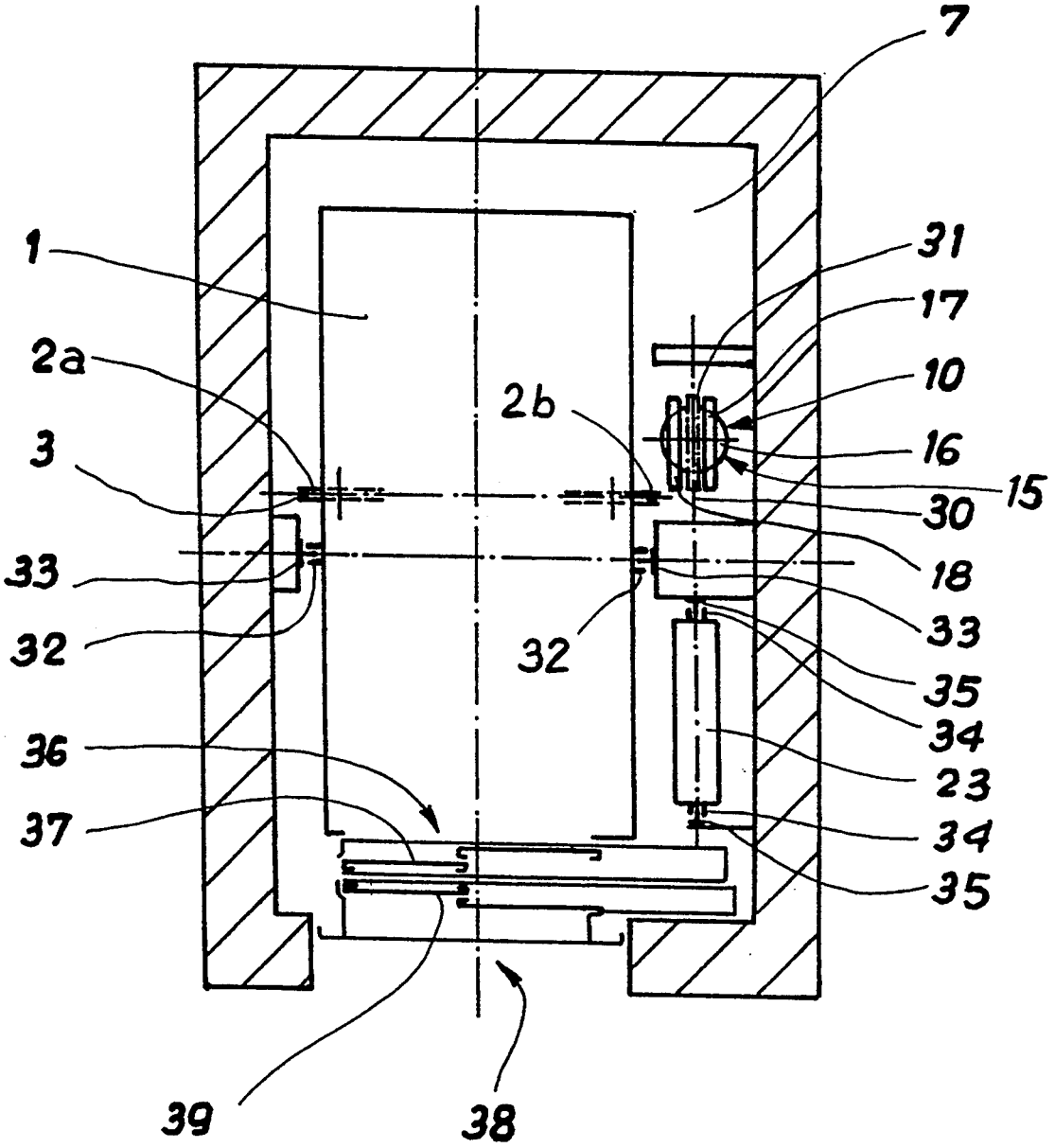
FIG. 3 is a horizontal cross-sectional schematic view taken through an elevator shaft showing the elevator car, the counterweight and the hydraulic drive shown in the FIG. 2.

The FIG. 3 is a horizontal cross-sectional view of the elevator system shown in the FIG. 2 with the car 1 guided in a vertical direction in the shaft 7 by a pair of car guides 32 attached to opposite sides of the car. The guides 32 engage a pair of guide rails 33 extending vertically on opposite side walls of the shaft 7. The car 1 is supported by the hoist cable 3 which engages the guide rollers 2*a* and 2*b*. The counterweight 23 is guided in a vertical direction by a pair of counterweight guides 34 attached to opposite sides of the counterweight 23. The guides 34 engage a pair of vertically extending counterweight guide rails 35 mounted in the shaft 7. The counterweight is supported by the counterweight cable 30 which engages the roller 31. The hydraulic drive 10 is positioned between the car 1 and a side wall of the shaft 7. Both of the guide rollers 17 and 18 for the hoist cable 3 of the elevator car 1 and the guide roller 31 for the counterweight cable 30 are rotatably mounted on the head end 16 of the piston rod 15. An entry opening 36 of the elevator car 1 is closed by a car door 37 and an access opening 38 to the shaft 7 is closed by a shaft door 39.

Figure 4:
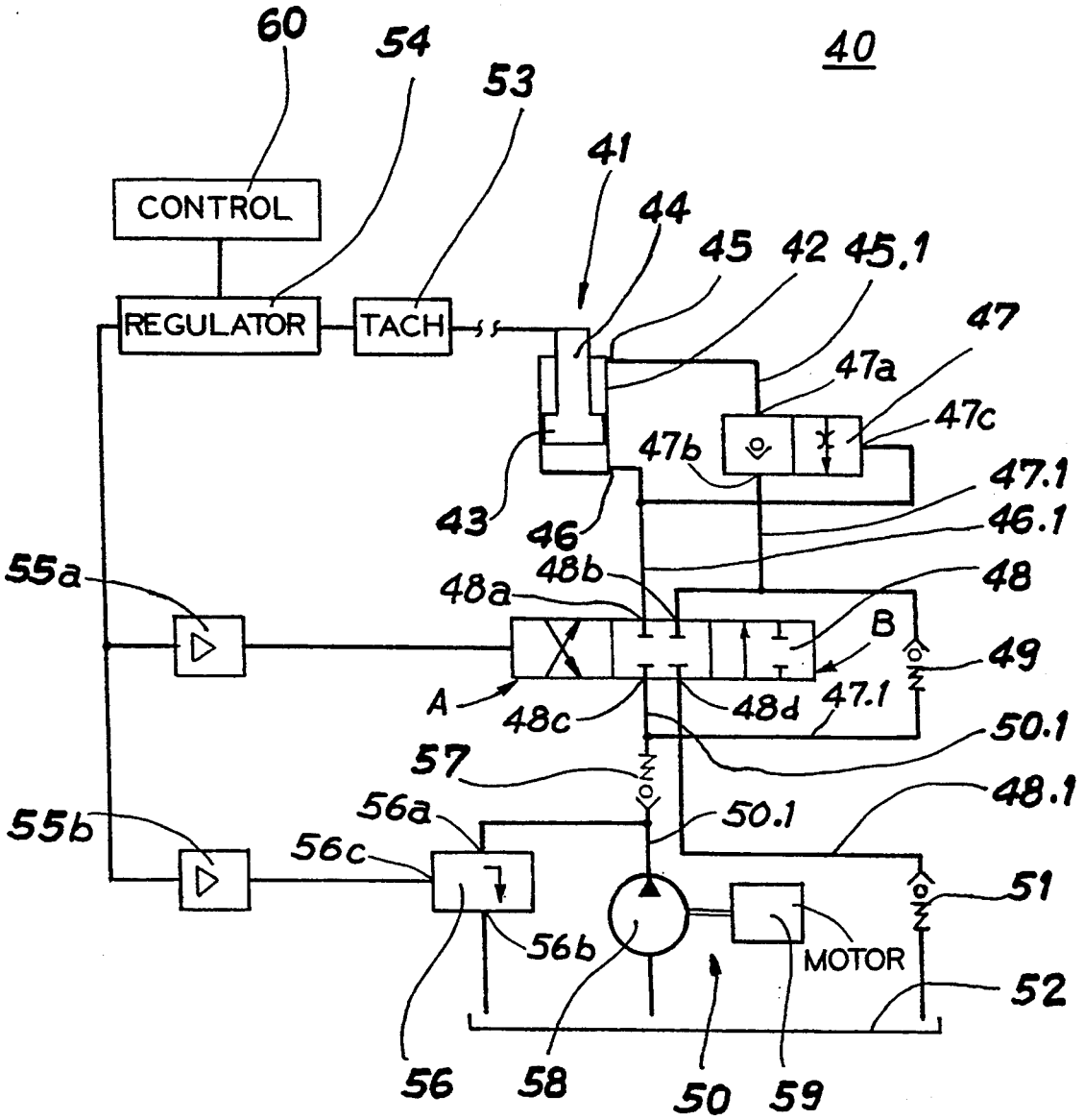
FIG. 4 is a schematic block diagram of a hydraulic control system for the hydraulic drives shown in the FIGS. 1 and 2.

There is shown in the FIG. 4 an hydraulic drive with a control for use with the elevator system shown in the FIGS. 2 and 3. An hydraulic control system 40 is connected to an hydraulic drive 41 having a cylinder 42, a piston 43 movable in the cylinder, and a piston rod 44 having one end attached to the piston and an opposite extending outwardly through an end of the cylinder. The cylinder 42 can be the cylinder 11, the piston 43 can be the piston 14, and the piston rod 44 can be the piston rod 15 shown in the FIGS. 1 and 2. A first opening 45 is formed in the upper end of the cylinder 42 above the piston rod 43 and a second opening 46 is in the lower end of the cylinder 42 below the piston 43. A first conduit or line 45.1 is connected from the opening 45 to a first port 47*a* of a throughflow check valve or lowering brake valve 47. A second line 46.1 is connected from the second opening 46 to a first port 48*a* of a proportional multi-way valve 48 having a central position and two working positions designated A and B. A second port 47*b* of the valve 47 is connected with a second port 48*b* of the valve 48 by a third line 47.1 which line also is connected through a first spring-loaded non-return valve 49 to a third port 48*c* of the valve 48. The third port 48*c* is connected by a main line 50.1 to an hydraulic fluid source 50. A fourth line 48.1 is connected from a fourth port 48*d* of the valve 48 through a second spring-loaded non-return valve 51 to an hydraulic fluid reservoir 52.

A tachogenerator 53 is coupled to the piston rod 44 for detecting the speed of travel of the rod 44 and generating an actual speed signal which is proportional to the speed of travel of the elevator car. An output of the tachogenerator 53 is connected to a speed regulator 54 which is included in an elevator control 60. The speed regulator 54 compares the actual speed signal a desired speed signal target value to generate a speed difference control signal. The speed regulator 54 is connected through a first proportional amplifier 55*a* to a control port 48*e* to actuate the valve 48 and is connected through a second proportional amplifier 55*b* to a control port 56*c* to actuate a proportional pressure-limiting valve 56 in order to regulate the pressure required in the hydraulic circuit for a certain speed of travel of the elevator car 1. The valve 56 has a first port 56*a* connected to the main line 50.1 and a second port 56*b* connected to the reservoir 52. The main line 50.1 has a third spring-loaded non-return valve 57 connected in series therewith between the third port 48*c* and the first port 56*a*. The valve 57 is also connected between the third port 48*c* and an outlet of the hydraulic fluid source 50. The source 50 includes a pump 58 having an inlet connected to the reservoir 52 and an outlet connected to the main line 50.1 and an electrical motor 59 coupled to drive the pump 58.

In the elevator system illustrated in the FIG. 2, the counterweight 23 is selected to balance the entire weight of the elevator car 1 and, for example, half of the carrying capacity of the elevator car 1. When it is desired that the car 1 travel in a downward direction as indicated by a solid arrow 61*a*, the piston 14 is moved in a downward direction as indicated by a solid arrow 61*b* and the counterweight travels in an upward direction as indicated by a solid arrow 61*c*. Conversely, when the car 1 is to travel in an upward direction as indicated by a dashed arrow 62*a*, the piston 14 is moved in an upward direction as indicated by a dashed arrow 62*b* and the counterweight travels in a downward direction as indicated by a dashed arrow 62*c*. In order for the elevator car 1 to move two units of distance in either direction, the piston 14 and the head end 16 of the rod 15 move one unit of distance in the same direction and the counterweight 23 moves two units of distance in the opposite direction. Thus, the force required to be applied by the hydraulic drive 10 at no load in the car corresponds to the full carrying capacity of the elevator car in the upward direction and, at full load in the car, corresponds to the full carrying capacity of the elevator car in the downward direction. A balancing of the elevator car load results at half the car capacity so that the force applied by the drive 10 theoretically becomes zero. Furthermore, the weight to be balanced by the counterweight 23 can be selected so that the force applied by the drive 10 becomes as small as possible for the car load arising most frequently.

The above described elevator system can be used in hydraulic elevator installations when the piston 43 of the hydraulic drive 41 is loaded by the pump 58 in both directions of movement. The control system 40 shown in the FIG. 4 must regulate two volume flows, one from the hydraulic fluid source 50 to the drive 41 and another one from the drive 41 to the source 50. During downward travel of the elevator car, a first volume of hydraulic fluid flows from the pump 58 through the ports 48*c* and 48*b* of the valve 48 actuated to the working position A and through the valve 47 to the upper side of the piston 43 through the opening 45 in the cylinder 42. This fluid flow tends to force the piston 43 in a downward direction such that a second volume of fluid flows from the cylinder 42 at the opening 46 on the lower side of the piston 43 through the ports 48*a* and 48*d* of the valve 48 and through the valve 51 back to the reservoir 52.

During upward travel of the elevator car, a first volume of fluid flows from the pump 58 through the ports 48*c* and 48*a* of the valve 48 actuated to the working position B to the lower side of the piston 43 in the cylinder 42 and, at the same time, is applied to the control port 47*c* to switch the valve 47 to permit flow in the opposite direction from the first port 47*a* to the second port 47*b*. The piston 43 is forced in an upward direction and a second volume of fluid flows from the upper side of the piston 43 through the valve 47 and through the valve 49 into the main line 50.1. The second volume flow from the cylinder 42 and the first volume flow emanating from the pump 58 combine to flow into the cylinder 42 on the lower side of the piston 43. Thus, a differential circulation of the hydraulic fluid arises, which permits the size of the pump to be dimensioned according to the required first fluid volume which corresponds to the difference between the cylinder volume on the lower side of the piston 43 minus the cylinder volume on the upper side of the piston, or corresponds to the cylinder volume on the upper side of the piston when it is greater.

The speed regulator 54 and the proportional pressure-limiting valve 56 continuously regulate towards the pressure required for a desired speed of travel of the elevator car. The nominal speed of the elevator car is directly dependent on the hydraulic fluid volume flow speed and can never be higher than the nominal speed resulting from the maximum possible pump volume flow. An additional throughflow check valve similar to the valve 47 may be required on the opposite side of the piston when leakage of the proportional multiway valve 48 is too great during the loading operation.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for reducing the power required to drive an hydraulic elevator, the elevator including a load carrying elevator car connected to an hydraulic piston-cylinder type drive by a hoist cable whereby upward and downward movements of the elevator car are controlled by fluid flow to and from a cylinder of the drive causing a piston in the cylinder to move upwardly and downwardly respectively, the elevator car moving two units of distance for each unit of distance moved by the piston in the cylinder of the drive, the method comprising the steps of:

a. connecting a counterweight to a piston in a cylinder of an hydraulic piston-cylinder type drive for movement of the counterweight in a direction opposite a direction of movement of the piston and an elevator car driven by the piston;

b. connecting a non-return valve to the cylinder between a source of pressured fluid and an upper side of the piston;

c. connecting a source of pressured fluid to the cylinder to apply pressured fluid to a lower side of the piston for movement of the elevator car in an upward direction and to circulate fluid through the non-return valve from the upper side of the piston to the lower side of the piston during the upward movement of the elevator car;

d. connecting the source of pressured fluid to the cylinder to apply the pressured fluid to the upper side of the piston for movement of the elevator car in a downward direction and removing fluid from the cylinder at the lower side of the piston during the downward movement of the elevator car; and e. disconnecting the source of pressured fluid from the cylinder during movement of the elevator car to stop the elevator car, the pressured fluid from the source of pressured fluid preventing fluid flow from the cylinder at the upper side of the piston through the non-return valve.

2. The method according to claim 1 including comparing a target value of elevator car speed with an actual value of the speed of the elevator car during upward and downward movement to generate a speed difference value, and regulating a proportional pressure-limiting valve connected to the source of pressured fluid in accordance with the speed difference value to limit a pressure of the pressured fluid applied to the piston to a desired speed of travel of the elevator car.

3. In an hydraulic elevator including an elevator car positioned for vertical movement in an elevator shaft, an hydraulic piston-cylinder type drive positioned laterally beside the elevator car in the shaft, the drive having a cylinder with one end attached a bottom portion of the shaft, a piston movable in the cylinder, and a piston rod extending upwardly through an opposite end of the cylinder, a first guide roller and a second guide roller rotatably mounted on the elevator car, a hoist cable having one end fixed to an upper point in an upper portion of the shaft and an opposite end fixed to a lower point in a lower portion of the shaft, a section of the hoist cable extending about a portion of the first and second guide rollers for supporting the elevator car in the shaft, a third guide roller rotatably attached to the bottom portion of the shaft, a fourth guide roller and a fifth guide roller rotatably mounted on a head end of the piston rod, the hoist cable extending downwardly from the upper point and about the first and second guide rollers, upwardly and about a portion of the fourth guide roller, downwardly and about a portion of the third guide roller, upwardly and about a portion of the fifth guide roller and downwardly to the lower point, the improvement comprising:

a counterweight;

a counterweight cable having one end attached to said counterweight and an opposite end fixed to a point in the upper portion of the shaft;

a sixth guide roller and a seventh guide roller rotatably mounted in the upper portion of the shaft;

an eighth guide roller rotatably attached to the head end of the piston rod, said counterweight cable extending downwardly from said opposite end and about a portion of said eighth guide roller, upwardly and about a portion of each of said sixth and seventh guide rollers and downwardly to said one end;

an hydraulic pump having a pressured fluid outlet and a fluid inlet connected to a reservoir of fluid;

a throughflow check valve having first and second ports;

a first line connected from an upper opening in the cylinder above the piston to said first port of said throughflow check valve;

a proportional multi-way valve having first, second, third and fourth ports;

a second line connected from said first port of said proportional multi-way valve to a lower opening in the cylinder below the piston;

a third line connected from said second port of said proportional multi-way valve through a first non-return valve for fluid flow to said third port of said proportional multi-way valve, said second port of said throughflow check valve being connected to said second port of said proportional multi-way valve by said third line;

a fourth line connected from said fourth port of said proportional multi-way valve through a second non-return valve for fluid flow to said reservoir; and a main line connected from said outlet of said pump through a third non-return valve for fluid flow to said third port of said proportional multi-way valve whereby said proportional multi-way valve is selectively actuatable to a first mode for fluid flow from said pump to said upper opening in the cylinder through said third port and said second port and fluid flow from said lower opening of the cylinder to said reservoir through said first port and said fourth port for downward travel of the elevator car and is selectively actuatable to a second mode for fluid flow from said pump to said lower opening in the cylinder through said third port and said first port and fluid flow from said upper opening of the cylinder to said third port for upward travel of the elevator car.

4. The hydraulic elevator according to claim 3 wherein said counterweight has a weight approximately equal to a weight of the elevator car plus a weight corresponding to half of a carrying capacity of the elevator car.

5. The hydraulic elevator according to claim 3 wherein said counterweight has a weight approximately equal to a weight of the elevator car plus a weight corresponding to a most frequently occurring elevator car load.

6. The hydraulic elevator according to claim 3 wherein an area of a lower pressure surface of the piston is twice as large as an area of an upper pressure surface of the piston.

7. The hydraulic elevator according to claim 3 including a proportional pressure-limiting valve connected between said pump outlet and said reservoir.

8. The hydraulic elevator according to claim 7 including a tachogenerator coupled to the piston rod for generating an actual speed signal proportional to a speed of travel of the elevator car, a speed regulator connected to said tachogenerator and responsive to said actual speed signal for generating a speed difference signal representing a difference between said actual speed signal and a signal representing a desired speed of the elevator car, a proportional amplifier connected between said speed regulator and a control port of said proportional pressure-limiting valve for selectively a pressure of the pressured fluid at said pump outlet.

9. The hydraulic elevator according to claim 3 including a tachogenerator coupled to the piston rod for generating an actual speed signal proportional to a speed of travel of the elevator car, a speed regulator connected to said tachogenerator and responsive to said actual speed signal for generating a speed difference signal representing a difference between said actual speed signal and a signal representing a desired speed of the elevator car, a proportional amplifier connected between said speed regulator and a control port of said proportional multi-way valve for selectively actuating said proportional multi-way valve between said first mode connecting said pump to the cylinder for downward travel of the elevator car and said second mode connecting said pump to the cylinder for upward travel of the elevator car.

10. An hydraulic elevator comprising:

an elevator car positioned for vertical movement in an elevator shaft;

an hydraulic piston-cylinder type drive positioned laterally beside said elevator car in the shaft, said drive having a cylinder with one end attached a bottom portion of the shaft, a piston movable in the cylinder, and a piston rod extending upwardly through an opposite end of said cylinder;

a hoist cable having one end fixed to an upper point in an upper portion of the shaft and an opposite end fixed to a lower point in a lower portion of the shaft, said hoist cable supporting said elevator car in the shaft and being coupled to said piston rod for moving said elevator car two units of distance for each unit of distance moved by said piston rod;

an hydraulic pump having a pressured fluid outlet and a fluid inlet connected to a reservoir of fluid;

a throughflow check valve having first and second ports;

a first line connected from an upper opening in said cylinder above said piston to said first port of said throughflow check valve;

a proportional multi-way valve having first, second, third and fourth ports;

a second line connected from said first port of said proportional multi-way valve to a lower opening in said cylinder below said piston;

a third line connected from said second port of said proportional multi-way valve through a first non-return valve for fluid flow to said third port of said proportional multi-way valve, said second port of said throughflow check valve being connected to said second port of said proportional multi-way vane by said third line;

a fourth line connected from said fourth port of said proportional multi-way valve through a second non-return valve for fluid flow to said reservoir; and a main line connected from said outlet of said pump through a third non-return valve for fluid flow to said third port of said proportional multi-way valve whereby said proportional multi-way valve is selectively actuatable to a first mode for fluid flow from said pump to said upper opening in said cylinder through said third port and said second port and fluid flow from said lower opening in said cylinder to said reservoir through said first port and said fourth port for downward travel of said elevator car and is selectively actuatable to a second mode for fluid flow from said pump to said lower opening in said cylinder through said third port and said first port and fluid flow from said upper opening in said cylinder to said third port for upward travel of the elevator car.

* * * * *